US007819443B2

(12) United States Patent
Ryan

(10) Patent No.: US 7,819,443 B2
(45) Date of Patent: Oct. 26, 2010

(54) DOOR LATCH ASSEMBLY

(75) Inventor: Jerry Ryan, Oak Creek, WI (US)

(73) Assignee: Ventfabrics, Inc., Chicago, IL (US)

( * ) Notice: Subject to any disclaimer, the term of this patent is extended or adjusted under 35 U.S.C. 154(b) by 282 days.

(21) Appl. No.: 11/942,509

(22) Filed: Nov. 19, 2007

(65) Prior Publication Data

US 2009/0127874 A1 May 21, 2009

(51) Int. Cl.
*E05B 3/00* (2006.01)
*E05B 13/10* (2006.01)

(52) U.S. Cl. ..... 292/336.3; 70/210

(58) Field of Classification Search ..... 292/336.3, 292/347, 210, 248, 350, DIG. 59, DIG. 71; 70/190, 207, 209, 210, 211, 215, 217, 218, 70/224, 445, DIG. 31, DIG. 67
See application file for complete search history.

(56) References Cited

U.S. PATENT DOCUMENTS 947,641 A * 1/1910 Lahr ..... 70/118
1,812,334 A 6/1931 Gloekler
2,160,611 A 5/1939 Alexander
2,219,626 A * 10/1940 Johnson ..... 74/535
2,473,937 A 6/1949 Cameron
2,701,735 A 2/1955 Segal
2,707,121 A 4/1955 Behnke
2,851,871 A 9/1958 Newell
2,949,328 A 8/1960 Kaiser
3,159,994 A 12/1964 Schulz
3,808,850 A * 5/1974 Walters ..... 70/215
4,471,984 A * 9/1984 Bellantuono ..... 292/350
4,583,775 A 4/1986 Bisbing
4,732,418 A 3/1988 Crown et al.
4,763,935 A 8/1988 Bisbing
5,172,944 A 12/1992 Munich et al.
5,184,853 A 2/1993 Whatley
D343,347 S 1/1994 Lau et al.
5,292,189 A 3/1994 Lau et al.
5,299,597 A 4/1994 Fort et al.
5,390,517 A * 2/1995 Yamada ..... 70/210
5,408,853 A * 4/1995 Yamada ..... 70/210
D360,345 S 7/1995 Swan et al.
5,469,725 A 11/1995 Yamada
5,481,889 A 1/1996 Richard et al.
5,505,505 A * 4/1996 Follows ..... 292/58
5,509,703 A 4/1996 Lau et al.
5,520,427 A 5/1996 Mader
D371,300 S 7/1996 Mordick
5,582,042 A 12/1996 Mordick
5,582,443 A 12/1996 Finkelstein et al.
5,620,290 A 4/1997 Homfeldt et al.
5,630,632 A 5/1997 Swan
5,634,357 A 6/1997 Nutter et al.
5,642,909 A 7/1997 Swan et al.

(Continued)

*Primary Examiner*—Peter M Cuomo
*Assistant Examiner*—Alyson M Merlino
(74) *Attorney, Agent, or Firm*—Barnes & Thornburg LLP

(57) ABSTRACT

A door latch assembly for use with a door. The door latch assembly includes first and second handles that are coupled to a pair of housings. The door latch assembly including an adjustable latch member that can be selectively coupled to either the first or second handle and can be incrementally repositioned with respect to the handle to which it is coupled to allow for adjustment of the adjustable latch member to the door.

8 Claims, 7 Drawing Sheets

U.S. PATENT DOCUMENTS 5,664,448 A 9/1997 Swan et al.
5,666,695 A 9/1997 Jergers et al.
D385,768 S 11/1997 Nutter et al.
5,683,005 A 11/1997 Mordick
5,704,100 A 1/1998 Swan
D391,143 S 2/1998 Jancsek
5,722,121 A 3/1998 Lau et al.
D396,397 S 7/1998 Swan
D400,076 S 10/1998 Jancsek et al.
5,862,690 A 1/1999 Jancek
5,879,035 A 3/1999 Jancsek et al.
D411,433 S 6/1999 Swan et al.
6,068,308 A * 5/2000 Molzer ..... 292/336.3
6,086,308 A 7/2000 Sjogren et al.
6,101,856 A 8/2000 Pelletier et al.
6,318,770 B1 * 11/2001 Molzer ..... 292/336.3
6,354,119 B1 * 3/2002 Molzer ..... 70/210
6,474,119 B1 11/2002 Halvorson et al.
6,494,509 B2 * 12/2002 Molzer ..... 292/336.3
6,502,872 B1 * 1/2003 Molzer ..... 292/336.3
6,662,605 B2 * 12/2003 Molzer ..... 70/210
6,702,342 B2 * 3/2004 Molzer ..... 292/336.3
6,715,807 B2 * 4/2004 Molzer ..... 292/336.3
6,868,703 B2 * 3/2005 Molzer ..... 70/210
6,874,825 B1 * 4/2005 Rauner ..... 292/61
6,952,940 B2 * 10/2005 Molzer et al. ..... 70/210

* cited by examiner

DOOR LATCH ASSEMBLY

FIELD OF THE INVENTION

The present disclosure relates to latches, and particularly to door latch assemblies that are used with doors.

BACKGROUND

Access doors are used in heating, ventilation, and air conditioning (HVAC) systems to provide access for maintenance, such as filter replacement, or repair. Access doors used with HVAC systems are formed from first and second panels and may include an insulation layer. The access doors are held in a closed position by use of a door latch assembly. In order to minimize system losses due to air leakage, the access doors must fit tightly against the gasket on the frame of the door. Due to variations in door frame thicknesses, it can be difficult to properly install a door latch assembly that tightly secures the access door.

SUMMARY

The present disclosure relates to a latch assembly for an access door that is used with a heating, ventilation and air conditioning (HVAC) system or for any other door. The latch assembly may comprise a first handle adapted to be pivotally coupled to a first side of the door and a second handle adapted to be pivotally coupled to a second side of the door opposite the first handle. The latch assembly may also comprise an adjustable latch member that is coupled to the second handle and adapted to be selectively repositionable with respect to the second handle to allow for the adjustment of the latch member with respect to the door. The latch mechanism is designed to retain the door in a closed position when in use and does not obstruct the opening of the door when the second handle is rotated to an open position.

In illustrative embodiments, the latch member is adjustable in that it includes a paw arm having a series of outwardly extending teeth that are adapted to engage a series of receptacles formed in the handle. This arrangement allows the latch member to be incrementally adjusted with respect to the handle so that the door can be properly secured in a closed position regardless of door frame thickness. The paw arm of the latch member includes a roller that is adapted to engage a door frame. Rotation of the handles causes the roller and paw arm to move away from the door frame to permit the door to open without damaging the door frame or associated gasket.

In illustrative embodiments, the handles each include a release mechanism having a trigger and a biased retention pin. The trigger is adapted to move relative to the handle and is oriented to engage and move the retention pin from an engaged position to a disengaged position. In the engaged position, the retention pin engages the housing to assist in securing the handle in an open horizontal position. Depressing the trigger causes the retention pin to disengage from the housing to allow the handles and latch member to be moved to a closed position to secure the door against the door frame.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The present invention and the advantages thereof will become more apparent upon consideration of the following detailed description when taken in conjunction with the accompanying drawings of which.

DETAILED DESCRIPTION

Figure 1:
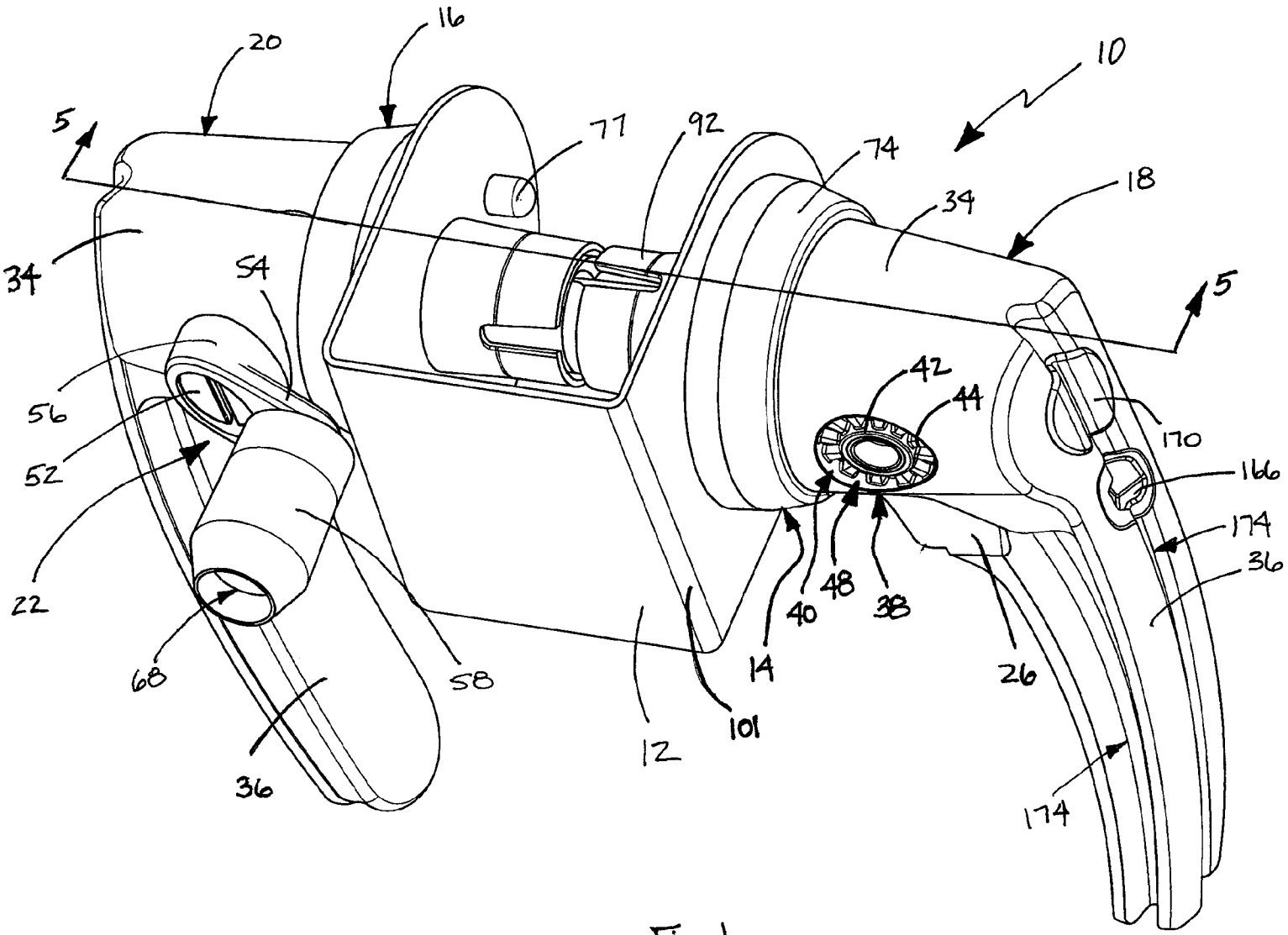
FIG. 1 is a perspective view of the door latch assembly in accordance with the present disclosure showing a pair of handles coupled to a portion of an access door and showing the left handle having an indexible latch member.

While the present disclosure may be susceptible to embodiment in different forms, there is shown in the drawings, and herein will be described in detail, embodiments with the understanding that the present description is to be considered an exemplification of the principles of the disclosure and is not intended to limit the disclosure to the details of construction and the arrangements of components set forth in the following description or illustrated in the drawings.

A door latch assembly 10 is shown coupled to a portion of an access door 12 and is used to secure door 12 in a closed position, as shown, for example, in FIG. 1. Door latch assembly 10 includes a pair of housings 14, 16 coupled to door 12 and a pair of handles 18, 20 that are pivotally coupled to housings 14, 16. Handles 18, 20 are identical in structure and each includes a pair of receivers 38 adapted to accept an indexible latch member 22 that is used to latch door 12 in a closed position, as shown, in the assembled view of FIG. 1 and in the exploded view of FIG. 4. The position of latch member 22 can be incrementally adjusted with respect to handles 18 or 20 to accommodate door frames of various thicknesses. Latch member 22 can also be positioned on either handle 18, 20 to permit the use of door latch assembly 10 on both inward and outward swing doors 12.

Figure 3:
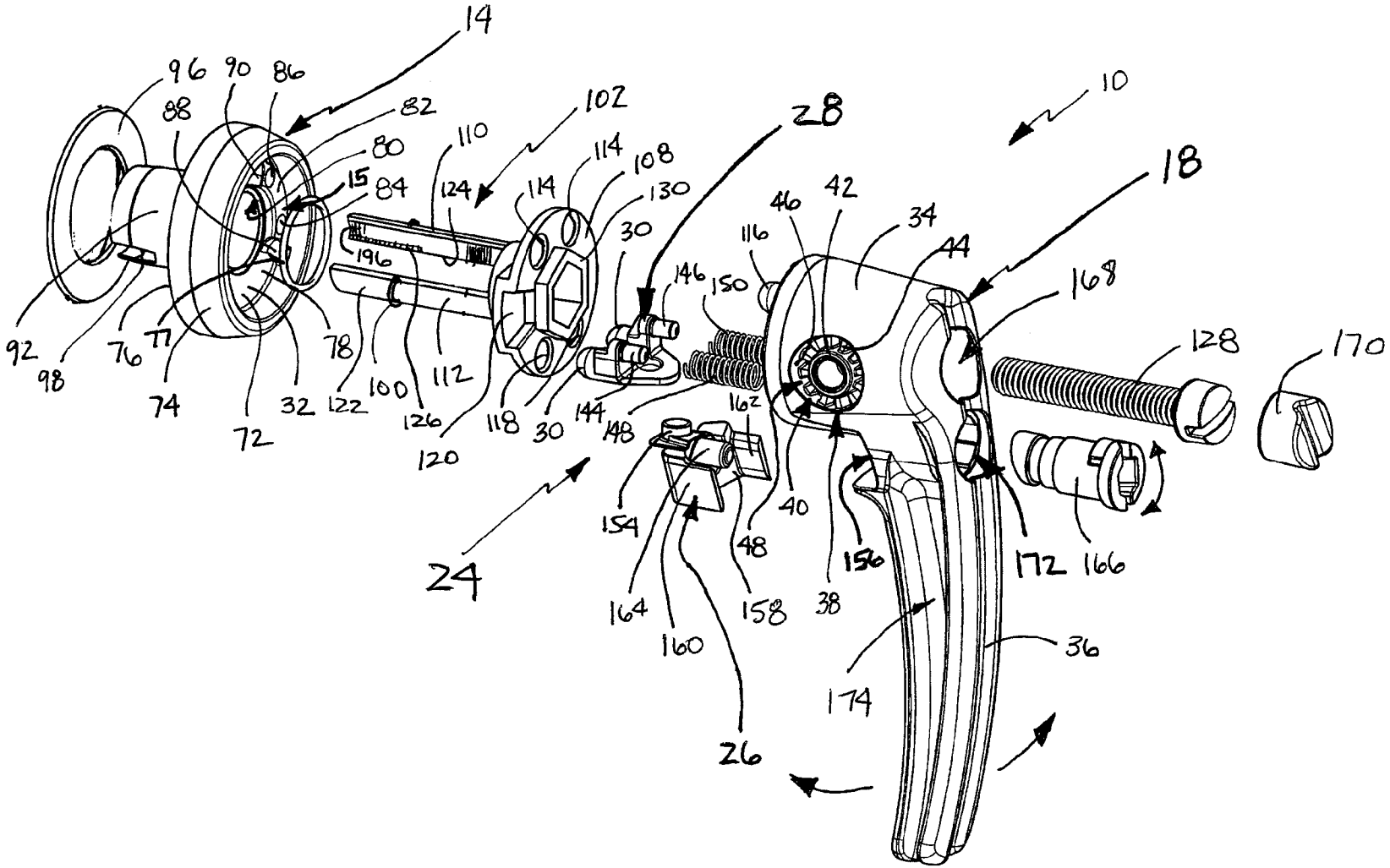
FIG. 3 is an exploded perspective view of a portion of the door latch assembly of FIG. 1.
Figure 9:
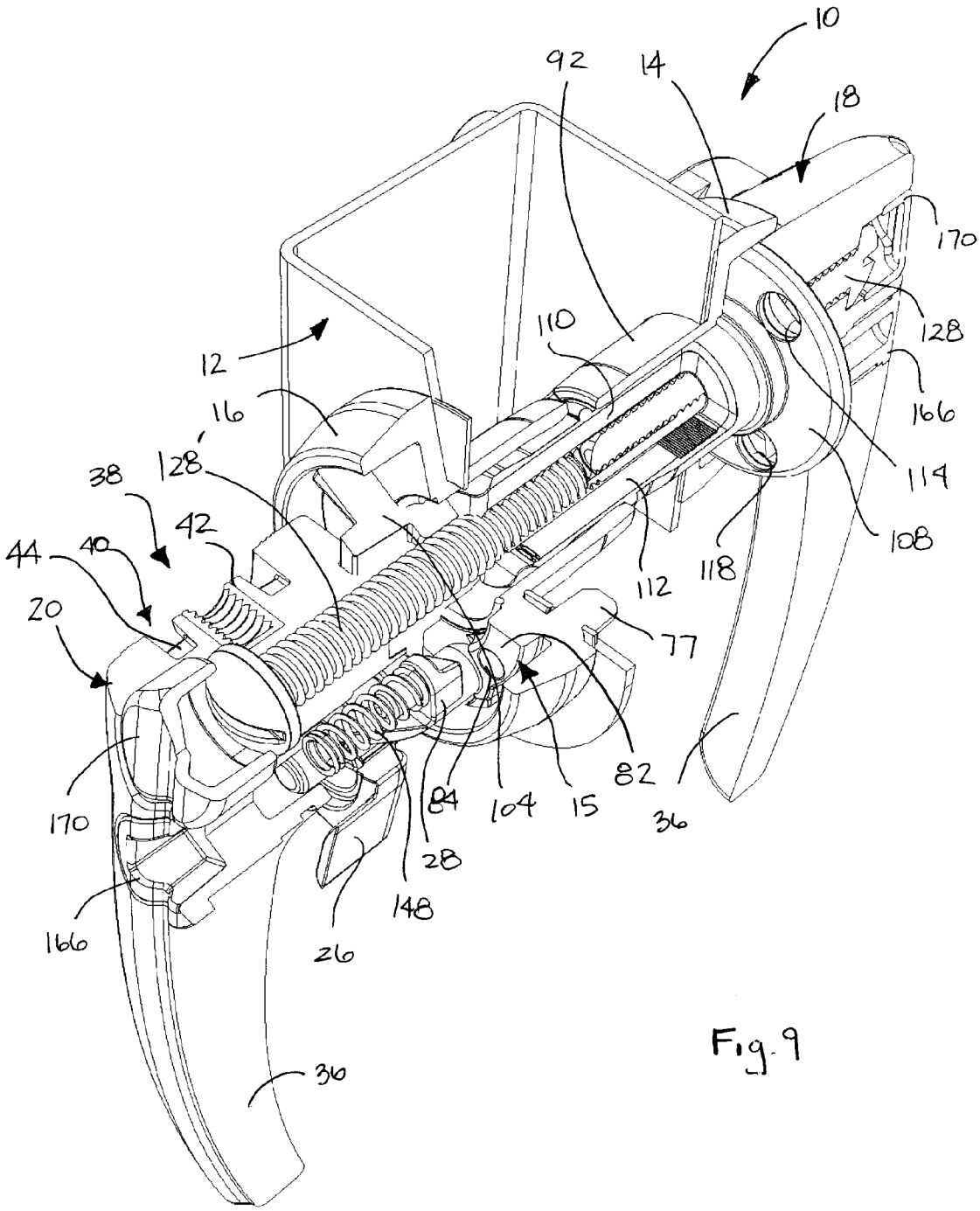
FIG. 9 is a perspective view of the latch assembly with portions of the latch assembly removed.

Door latch assembly 10 also includes a retention mechanism 24 that is comprised of a trigger 26 and a biased retention pin 28, as shown, for example, in FIGS. 3 and 9. Trigger 26 is slidably coupled to handle 18 and is adapted to engage and retract retention pin 28 when trigger 26 is depressed by a user. Retention pin 28 includes a pair of support posts 30 that are adapted to slide along a bearing surface 32 of housing 14. Housing 14 includes a retention zone 15 that holds handle 18 in an open horizontal position to prevent handle 18 from returning to the vertical position. Depressing trigger 26 causes the retraction of retention pin 28 from retention zone 15 to allow handle 18 to be rotated with respect to housing 14 to a closed position. Alternatively, a user can rotate handle 18 to a vertical position without depressing trigger 26.

Figure 2:
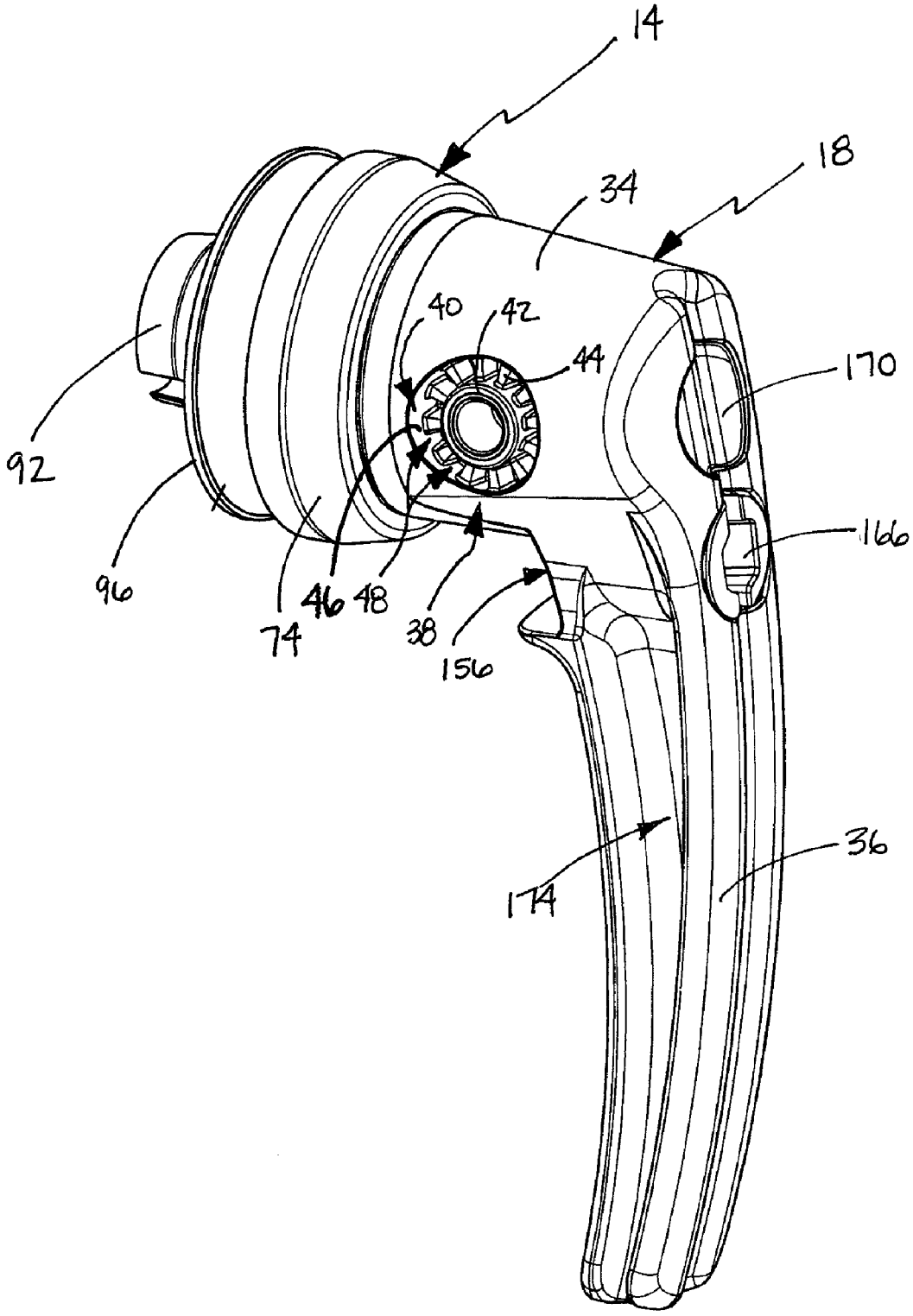
FIG. 2 is a perspective view of one of the handles of the door latch assembly coupled to a housing.
Figure 4:
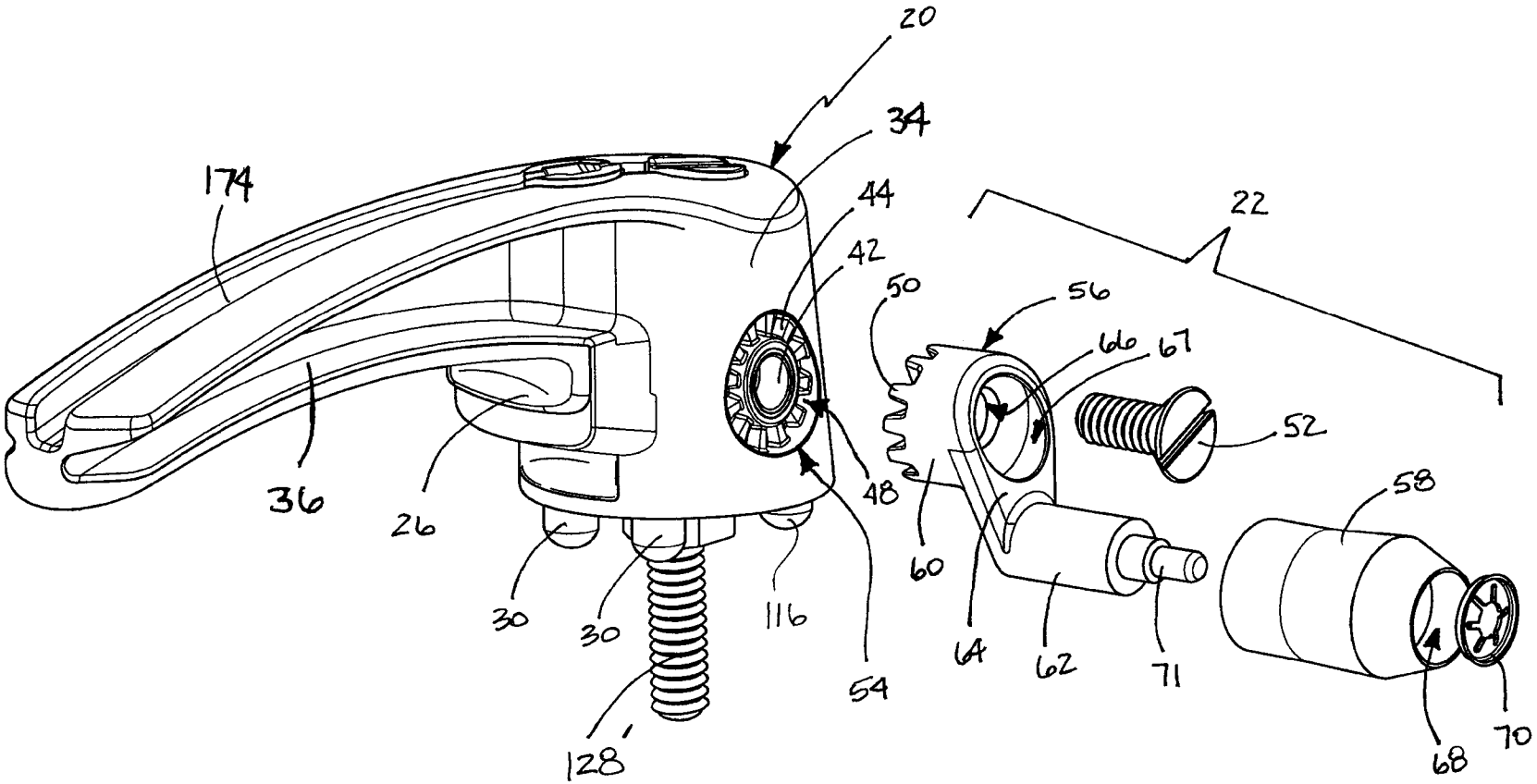
FIG. 4 is an exploded perspective view of the latch mechanism of FIG. 1 coupled to a handle.

Paragraph 20: Handle 18 of door latch assembly 10 includes a cylindrical body 34 and an elongated stem 36 extending from body 34, as shown, for example, in FIG. 2. Since handles 18 and 20 are identical in construction only one will be described in detail. Body 34 of handle 18 includes a receiver 38 for receiving latch member 22. Receiver 38 includes an annular recess 40 formed in body 34. Receiver 38 also includes an annular wall 42 positioned within recess 40 and is provided with a series of ribs 44 that extend from annular wall 42 to an inner surface 46 of annular recess 40 to form receptacles 48. Receptacles 48 are adapted to accept corresponding teeth 50 of latch member 22, as shown in FIG. 4. Annular wall 42 is threaded on an inner surface to accept a fastener 52 that is used to secure latch member 22 to body 34 of handle 18. Handle 18 also includes a second receiver 54 positioned on an opposite side of body 34 to allow latch member 22 to be coupled to either side of handle 18 so that handle 18 can be used on either side of door 12.

Latch member 22 is used to retain door 12 in a closed position and is adapted to be selectively coupled to either handle 18, 20 of door latch assembly 10 to accommodate both inward and outward swing doors, as shown, for example, in FIGS. 1 and 4. Latch member 22 includes a paw arm 56 and a latch roller 58. Paw arm 56 is shown in the illustrative embodiment as having a cylindrical base 60, a post 62 and a web 64 interconnecting post 62 to base 60. Base 60 of paw arm 56 includes the outwardly extending teeth 50 that are adapted to engage receptacles 48 formed in handles 18, 20. Base 60 of paw arm 56 also includes a central passageway 66 that is adapted to allow a portion of fastener 52 to extend therethrough. Base 60 further includes an annular recess 67 that is adapted to accept the head of fastener 52.

Teeth 50 of base 60 allow paw arm 56 to be repositioned in increments with respect to handle 18 to provide a range of adjustment to accommodate door frames of varying thicknesses. To reposition paw arm 56 with respect to handle 18, fastener 52 is unthreaded from handle 18 and paw arm 56 is removed from handle 18 and rotated until latch roller 58 is positioned against the door frame when door 12 is in a closed position. Once paw arm 56 is in the desired position, paw arm 56 is reinserted into receiver 38 of handle 18 and fastener 56 is reattached. Once paw arm 56 is adjusted for a given door/frame combination, it does not have to be repositioned again unless door latch assembly 10 is moved to a different door.

Latch roller 58 of latch member 22 is a cylindrical shaped structure having a central aperture 68 adapted to be positioned around post 62 of paw arm 56, as shown, for example, in FIG. 4. The diameter of aperture 68 is greater than the diameter of post 62 to allow latch roller 58 to rotate about post 62. Latch roller 58 is secured to post 62 by use of a retainer 70. Post 62 includes a recessed portion 71 that is adapted to accept retainer 70.

Figure 6:
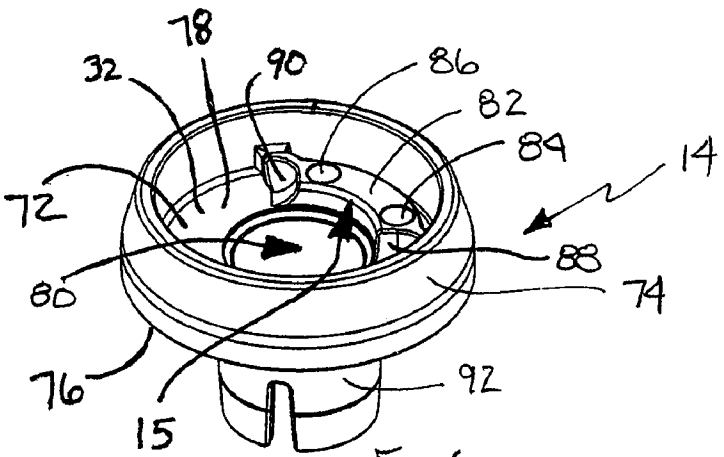
FIG. 6 is a perspective view of the housing.
Figure 7:
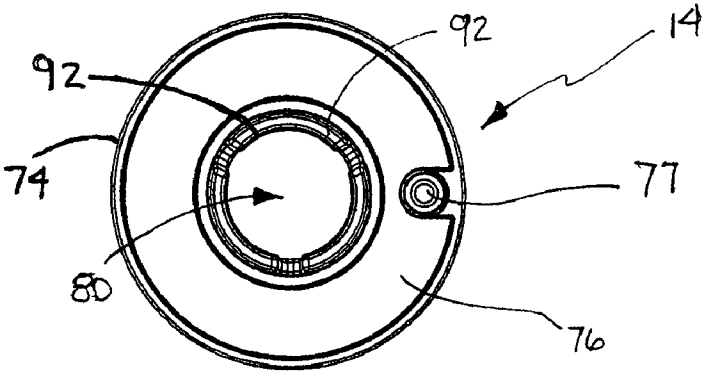
FIG. 7 is a bottom view of the housing of FIG. 6.

Housing 14 is positioned to lie near a leading edge 101 of door 12 and includes a bottom wall 72 and an annular side wall 74, as shown, for example, in FIGS. 1 and 6. Since housings 14, 16 are identical in construction, only one will be described in detail. Bottom wall 72 includes a first side surface 76 and a second side surface 78. First side surface 76 faces door 12 and includes a positioning stud 77 that is used to properly position housing 14 on door 12. Second side surface 78 includes a bearing surface 32 that is slidably engaged by support posts 30 of retention pin 28 when door latch assembly 10 is assembled.

The interaction of support posts 30 and bearing surface 32 creates friction to allow handle 18 to remain in a position selected by the user. Bottom wall 72 is also formed to include a central opening 80 that is adapted to accept half shaft 102 therethrough, as shown in FIG. 3. Annular side wall 74 of housing 14 is adapted to conceal bearing surface 32 and support posts 30 when door latch assembly 10 is assembled. An o-ring 77 is used between housing 14 and half shaft 102 to provide an air seal.

Paragraph 26: Bottom wall 72 is also provided with retention zone 15 that includes a plateau 82, as shown in FIGS. 3 and 6. Plateau 82 is positioned generally in the region of positioning stud 77 on the second side surface 78 of bottom wall 72. It is important when installing housing 14 that plateau 82 is properly oriented on door 12 to ensure that door latch assembly 10 operates as intended. Plateau 82 should be positioned toward the hinges of door 12. As an example, if housing 14 is installed on the inside surface of a inward swing door, plateau 82 would be pointed toward the axis of rotation of the door. If housing 14 is installed on the inside surface of an outward swing door, plateau 82 would still point toward the axis of rotation of the door.

Plateau 82 of retention zone 15 includes first and second detention apertures 84, 86 that are adapted to retain support posts 30 of retention pin 28 when handle 18 is rotated 90 degrees from the vertical or closed position, as shown, for example, in FIGS. 3 and 6. The bullet shape of support posts 30 and the diameter of detention apertures 84, 86 allows support posts 30 to be released from detention apertures 84, 86 when a clockwise rotation force is applied to handle 18. Positioned at the sides of plateau 82 are cam ramps 88, 90. Cam ramps 88, 90 are adapted to assist support posts 30 in transitioning from bearing surface 32 up to plateau 82.

Housing 14 also includes an annular sleeve 92 that extends outwardly from first side 76 of housing 14, as shown, for example, in FIGS. 3 and 6. Sleeve 92 is adapted to be inserted into a hole drilled in door 12 near leading edge 101 of door 12. Sleeve 92 includes an interior groove 98 that is adapted to engage an annular rib 100 formed on half shaft 102 to retain housing 14 to half shaft 102. Door latch assembly 10 also includes gasket 96 that is adapted to seal housing 14 to door 12.

Figure 5:
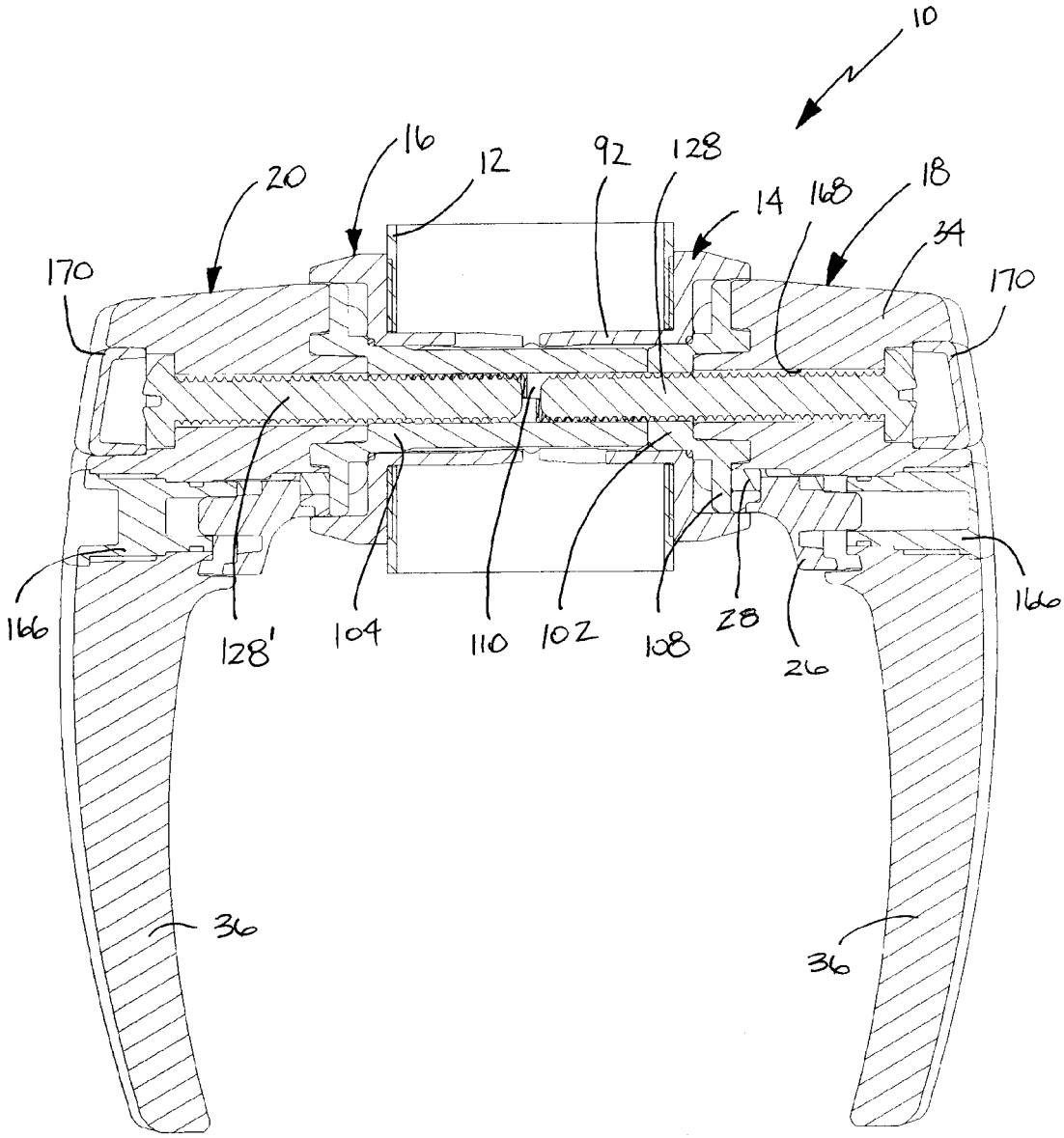
FIG. 5 is a cross sectional view of the door latch assembly taken along line 5-5 of FIG. 1.

Paragraph 29: Handles 18, 20 are coupled together by use of a pair of half shafts 102, 104 and a pair of handle bolts 128, 128', as shown in FIGS. 3 and 5. Since half shafts 102, 104 are identical in construction only one will be described in detail. The interconnection of handles 18, 20 permits rotation of both handles at the same time, as shown, for example, in FIGS. 3 and 5. Thus, rotation of first handle 18 causes the rotation of second handle 20.

Half shaft 102 includes a flange 108 and a pair of arcuate fingers 110, 112 that extend outwardly from flange 108, as shown, for example, in FIG. 3. Flange 108 of half shaft 102 includes a first pair of apertures 114 that are adapted to accept posts 116 of handle 18 so that rotation of handle 18 causes rotation of shaft 102. Flange 108 also includes a second set of apertures 118 that are adapted to accept posts 30 of retention pin 28. Flange 108 is formed to include a recessed wall portion 120 that is adapted to slide along bearing surface 32 of housing 14 when handle 18 is rotated.

Fingers 110, 112 extend outwardly from flange 108 and have a curved outer surface 122 having annular rib 100, as shown in FIG. 3. Fingers 110, 112 also include a curved inner surface 124. Inner surfaces 124 of fingers 110, 112 include a plurality of threads 126 that are adapted to mesh with threads of handle bolt 128. Annular rib 100 is adapted to be coupled to sleeve 92 of housing 14 to secure housing 14 to door 12. Flange 108 includes a hexagonal ring 130 that is adapted to engage angular faces 132 of retention pin 28 to retain the orientation of retention pin 28 during lateral movement.

Figure 8:
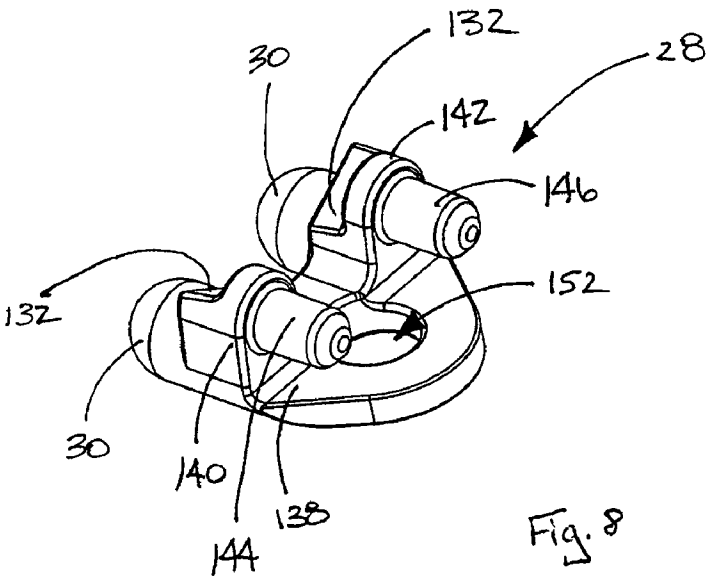
FIG. 8 is a perspective view of the retention pin.

Retention mechanism 24 of door latch assembly 10 includes retention pin 28, trigger 26 and springs 148, 150, as shown, for example, in FIG. 3. Retention pin 28 includes a base member 138 and two upwardly extending columns 140, 142, as shown, for example, in FIG. 8. Columns 140, 142 each include an angular face 132 that is adapted to engage hexagonal ring 130 of half shaft 102 when door latch assembly 10 is assembled. Columns 140, 142 also include cylindrical projections 144, 146 that are adapted to engage springs 148, 150. Springs 148, 150 bias retention pin 28 away from handle 18 toward housing 14.

Base member 138 of retention pin 28 is formed to include an aperture 152 that is adapted to engage an actuator post 154 of trigger 26, as shown in FIGS. 3 and 9. Pulling trigger 26 toward stem 36 of handle 18 causes actuator post 154 to pull retention pin 28 toward handle 18 against the biasing force of springs 148, 150 to a release position. Release of trigger 26 allows springs 148, 150 to move retention pin 28 back to the engaged position. The use of spring loaded retention pin 28 and trigger 26 resists unintentional opening or closing of door 12.

Trigger 26 is coupled to handle 18 and is adapted to release retention pin 28 when pulled. Trigger 26 is positioned to lie within recess 156 of handle 18 and includes a leading wall 158 and a pair of backswept wall segments 160, 162, as shown, for example, in FIG. 3. Trigger 26 also includes an actuator post 154 that is adapted to engage retention pin 28. Trigger 26 further includes an outwardly extending stud 164 that is adapted to engage a lockout insert 166. Positioning lockout insert 166 in a lockout position prevents trigger 26 from moving toward handle 18. Rotating lockout insert 166 to a release position allows trigger 26 to move toward handle 18, which causes the retraction of retention pin 28 from housing 14.

Handle 18 includes an upper aperture 168 adapted to allow a portion of handle bolt 128 to pass through, as shown in FIG. 3. Upper aperture 168 is also adapted to accept a bolt cap 170 that is used to conceal handle bolt 128 after door latch assembly 10 is completely assembled. Handle 18 also includes a lower aperture 172 that is adapted to accept lockout insert 166. Stem 36 of handle 18 includes a series of linear grooves 174 that extend along the length of stem 36 to provide additional strength to stem 36 of handle 18.

Handle bolts 128, 128' are used to couple first and second half shafts 102, 104, as shown, for example, in FIG. 5. A first handle bolt 128 passing through handle 18 engages threads formed on fingers 110, 112 of second half shaft 104 to couple handle 18, housing 14, first half shaft 102, and second half shaft 104 together. A second handle bolt 128', passing through handle 20, engages threads of fingers of first half shaft 102 to couple handle 20, housing 16, second half shaft 104 and first half shaft 102 together. Thus, first handle 18 is coupled to second half shaft 104 by use of handle bolt 128 from one side of door 12 and second handle 20 is coupled to first half shaft 102 by use of a second handle bolt 128' on the other side of door 12.

Door latch assembly 10 is thermally broke in that door latch assembly 10 has no exposed material capable of transmitting large amounts of heat through door 12 in either direction. In the preferred embodiment the only components of door latch assembly 10 that are metal, besides the springs, are flanges 102, 104 and bolts 128. The remaining components are preferably manufactured from a plastics material, which acts as an insulator, to limit the amount of heat transfer through door 12.

Door latch assembly 10 is versatile in that it works for both inward and outward swing doors using the same set of components, which saves costs and reduces complexity at a manufacturing level. Door latch assembly 10 can also be used for out-swing and in-swing doors without the need for additional components which reduces the number of door latch assembly kits that need to be manufactured to accommodate different doors.

In use, an installer first determines whether they have a left hand or right hand swing door. If the door is hinged on the right and the door swings inwardly, the installer drills a large hole and a small hole near free edge 101 of door 12. The smaller hole is located between the large hole and the hinges of the door along a line that is perpendicular to the axis of rotation of the hinges. Installation has been designed to be simple in that the installer only needs to locate and drill two properly sized holes through the door. Once the holes are drilled, the installer only needs a standard flat head screw driver to complete the installation.

Once the holes are drilled, the installer places gasket 96 and first housing 14 on the inside surface of the door so that annular sleeve 92 is positioned within the large hole and the positioning stud 77 is positioned in the small hole. In this position, plateau 82 and positioning stud 77 of first housing 14 are positioned between the large hole and the hinges of the door along a line that is perpendicular to the axis of rotation of the hinges, as shown, for example, in FIG. 3. Once the holes are drilled in door 12, the installer then inserts fingers 110, 112 of first half shaft 102 into opening 80 of housing 14 with recessed wall 120 of half shaft 102 positioned opposite of plateau 82 and resting against bearing surface 32.

With first half shaft 102 in position, the installer then positions handle 18, which has been pre-assembled with trigger 26, springs 148, 150, and retention pin 28, against flange 108 of first half shaft 102 with stem 36 of the handle 18 facing downwardly. In this position, posts 116 of handle 18 are positioned within apertures 114 and posts 30 of retention pin 28 are positioned within apertures 118 of first half shaft 102.

With the first handle 18 in position, the installer next positions second housing 16 on the second side of door 12, second half shaft 104 through housing 16, and couples second handle 20 to first half shaft 102 by use of second handle bolt 128'. The installer then couples the first handle bolt 128 to second half shaft 104. Once handles 18, are properly secured to door 12, the installer next installs indexible latch member 22. Since the installer is installing the door latch assembly 10 on a door that is hinged on the right and swings in the direction of first handle 18, the installer would install the indexible latch member 22 on the second door handle 20 on the receiver 38 closest to edge 101 of door 12.

To install indexible latch member 22, the installer inserts teeth 50 of paw arm 56 into receptacles 48 so that latch roller 58 engages the door frame when door 12 is in a closed position. Given the number of teeth 50, paw arm 56 can be indexed to accommodate door frames of varying thicknesses. Once the proper position of paw arm 56 with respect to second handle 20 is selected, fastener 52 is threaded into annular wall 42.

To open door 12 after door latch assembly 10 is installed, a user on the inside of the door rotates first handle 18 counterclockwise ninety degrees. During rotation of first handle 18, posts 30 of retention pin 28 slide across bearing surface 32 until one of the posts engages cam ramp 88. Cam ramp 88 forces posts 30 and retention pin 28 slightly rearwardly, toward handle 18 so that posts 30 can ramp up to plateau 82. Further rotation causes posts 30 of retention pin 28 to engage detention apertures 84, 86 which retain stem 36 of handle 18 in a horizontal plane. Posts 30 will remain on plateau 82 until the user forcibly rotates handle 18 in a clockwise direction to return handle 18 to a vertical position with stem 36 pointing downwardly.

Because first and second handles 18, 20 are interconnected by half shafts 102, 104 by use of handle bolts 128, rotation of first handle 18 causes rotation of second handle 20. Since indexible latch member 22 is coupled to second handle 20, rotation of second handle 20 also causes movement of indexible latch member 22 so that latch roller 58 clears the door frame to allow door 12 to open.

While embodiments have been illustrated and described in the drawings and foregoing description, such illustrations and descriptions are considered to be exemplary and not restrictive in character, it being understood that only illustrative embodiments have been shown and described and that all changes and modifications that come within the spirit of the disclosure are desired to be protected. The description and figures are intended as illustrations of embodiments of the disclosure, and are not intended to be construed as having or implying limitation of the disclosure to those embodiments.

There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure and the appended claims.

The claimed invention is:

1. A latch assembly for use with a door that is hingedly coupled to a door frame, the latch assembly comprising:

(a) a first handle adapted to be pivotally coupled to a first side of the door;

(b) a second handle adapted to be pivotally coupled to a second side of the door opposite the first handle;

(c) an adjustable latch member that is selectively coupled to either of the first handle and the second handle and adapted to be selectively repositionable with respect to said selected one of the first handle and the second handle to allow for adjustment of the adjustable latch member with respect to the door frame; and (d) a fastener;

wherein the adjustable latch member does not obstruct the opening of the door when the selected one of the first handle and the second handle is rotated to an open position, the adjustable latch member including a paw arm having a generally cylindrical shaped base including a series of teeth defining a plurality of receptacles, each of the first and second handles includes an annular wall defining a recess and a series of ribs disposed within the recess defining a plurality of receptacles and an opening concentric with the recess, the opening configured to receive the fastener for selectively coupling the adjustable latch member to the selected one of the first handle and the second handle; and wherein, when the paw arm is engaged with the selected one of the first handle and the second handle at least some of the receptacles of the plurality of receptacles defined by the ribs of the selected one of the first handle and the second handle receive the teeth of the paw arm and the ribs of the selected one of the first and the second handle are received by at least some of the receptacles of the plurality of receptacles defined by the paw arm.

2. The latch assembly of claim 1, wherein the adjustable latch member includes a latch roller that is adapted to engage the door frame.

3. The latch assembly of claim 1, wherein the teeth of the paw arm are also adapted to be selectively coupled to other receptacles of the plurality of receptacles defined by the selected one of the first handle and the second handle.

4. The latch assembly of claim 3, wherein the latch roller is coupled to the paw arm.

5. latch assembly of claim 1, wherein the handles are manufactured from a thermally insulative material to limit the amount of heat loss through the door.

6. The latch assembly of claim 1 wherein the adjustable latch member is readily removable from said selected one of the first handle and the second handle when the first and second handles are coupled to the door.

7. The latch assembly of claim 6, wherein the adjustable latch member includes a latch roller that is adapted to engage the door frame.

8. The latch assembly of claim 6, wherein the teeth of the paw arm are also adapted to be selectively coupled to other receptacles of the plurality of receptacles defined by the selected one of the first handle and the second handle and to be readily removed from said other receptacles when the first and second handles are coupled to the door.

* * * * *